United States Patent [19]

Rockar et al.

[11] Patent Number: 4,683,693

[45] Date of Patent: Aug. 4, 1987

[54] SLOPED GLAZING SYSTEM

[75] Inventors: James A. Rockar, Tarentum; James E. Ignatius, McMurray, both of Pa.

[73] Assignee: PPG Industries, Inc., Pittsburgh, Pa.

[21] Appl. No.: 806,584

[22] Filed: Dec. 9, 1985

[51] Int. Cl.[4] ..... E04B 7/00

[52] U.S. Cl. ..... 52/198; 52/209; 52/235; 52/464

[58] Field of Search ..... 52/200, 209, 397, 459, 52/464, 465, 466, 467, 469

[56] References Cited

U.S. PATENT DOCUMENTS

| | | | |
|---|---|---|---|
| 3,830,029 | 8/1974 | Yance | 52/464 X |
| 3,844,086 | 10/1974 | Radtke | 52/464 X |
| 3,844,087 | 10/1974 | Schultz et al. | 52/209 X |
| 4,455,798 | 6/1984 | Tsakiris | 52/200 |
| 4,471,584 | 9/1984 | Dietrich | 52/209 X |
| 4,543,755 | 10/1985 | Crandell | 52/235 |

FOREIGN PATENT DOCUMENTS

| | | | |
|---|---|---|---|
| 2507648 | 12/1982 | France | 52/209 |

*Primary Examiner*—William F. Pate, III
*Assistant Examiner*—Creighton Smith
*Attorney, Agent, or Firm*—Donald Carl Lepiane; Robert A. Westerlund, Jr.

[57] ABSTRACT

A sloped glazing system for a building or the like includes a plurality of rafters and purlins interconnected together to form a framing grid, and further includes a plurality of glazing panels secured to the framing grid in covering relation to the glazing openings. The framing grid is attached to the building in a manner such that the framing grid subtends an oblique angle with respect to the horizontal plane of the building. Each glazing panel has a hanger frame mounted to its inner major surface. Each hanger frame includes a plurality of hanger sections mounted to the inner major surface of the associated glazing panel adjacent to a corresponding plurality of panel side edges. Spanning facilities are provided in bridging relation to immediately adjacent ones of the hanger sections mounted to adjacent ones of the panels. The spanning facilities are attached to the framing grid to thereby secure the panels to the framing grid. Spaces occurring between adjacent ones of the panels are preferably sealed with a bead of a silicone adhesive. The outer surfaces of the silicone adhesive beads are preferably at least substantially flush with the outer major surfaces of the panels.

21 Claims, 9 Drawing Figures

SLOPED GLAZING SYSTEM

FIELD OF THE INVENTION

The present invention relates generally to sloped glazing systems, and more particularly, to a novel underside-mounted sloped glazing system.

BACKGROUND OF THE INVENTION

Sloped or overhead glazing systems generally include a plurality of horizontal framing members or purlins and vertical framing members or rafters interconnected to form a structural framing grid which provides a plurality of glazing openings into which architectural panels, e.g. glass panels, are secured. The framing grid is attached to a building superstructure. The grid usually has a slope or pitch of about 15° to about 75° as measured from the horizontal plane of the superstructure. Typically, each purlin and each rafter consists of two primary parts, one on the inside of the panels and one on the outside of the panels. The primary parts are interconnected to form glazing recesses or pockets adapted to receive and retain marginal edge portions of the panels. Various forms of connector and sealing components are employed to secure the panels within the glazing pockets and to minimize infiltration of moisture, air, dust, and other elements, from the outside to the inside of the glazing pockets. Typical sealing components comprise resilient sealing gaskets which grip the inner and outer panel surfaces. The tightening force applied to the connector components to interconnect the inside and outside primary parts of the purlins and rafters compressively biases the panel gripping gaskets against the inside and outside panel surfaces to securely retain the glazing panels within the framing grid and to minimize penetration of moisture, air, and the like into the glazing pockets and the building interior.

Representative examples of the above-described type of sloped glazing systems are taught in U.S. Pat. Nos. 3,719,014 and 4,448,001, as well as in U.S. application Ser. No. 768,985 filed in the name of James A. Rockar on Aug. 26, 1985 for an invention entitled "Rafter with Internal Drainage Feature and Sloped Glazing System Incorporating Same," all teachings of which are herein incorporated by reference. Although this general type of sloped glazing system has been generally acceptable, it would be advantageous to provide a system having a framing grid wholly disposed interiorly of the outer plane of the glazing panels, to thereby provide an alternative aesthetic solution for the sloped glazing system. It would be further advantageous to have a sloped glazing system of the above type which is structurally sound and which is easy and economical to erect.

SUMMARY OF THE INVENTION

The present invention relates to a sloped glazing system for a building or the like, including a plurality of rafters and purlins interconnected together to form a framing grid having a plurality of glazing openings disposed at an oblique angle with respect to the horizontal plane of the building, and further including a plurality of glazing panels secured to the framing grid in covering relation to the glazing openings. Each glazing panel has a hanger frame mounted to its major surface facing the building interior, i.e., its inner major surface. Each hanger frame includes a plurality of hanger sections mounted to the inner major surface of the associated panel adjacent to a corresponding plurality of panel side edges. A plurality of elongated members are disposed in bridging or spanning relation to immediately adjacent ones of the hanger sections mounted to adjacent ones of the panels, the elongated members being attached to the framing grid to thereby secure the panels to the framing grid. The elongated members bridging vertically adjacent ones of the hanger sections are preferably adapted to cooperatively engage a plurality of setting block chairs. The system preferably further includes a plurality of setting blocks interposed between corresponding ones of the setting block chairs and the lower horizontal edges of the panels. The setting block chairs and the setting blocks coact or cooperatively function to vertically support the panels. Spaces occurring between adjacent ones of the panels are preferably sealed with a bead of a silicone adhesive. The outer surfaces of the silicone adhesive beads are preferably at least substantially flush with the outer major surfaces of the panels.

DESCRIPTION OF THE INVENTION

Figure 1:
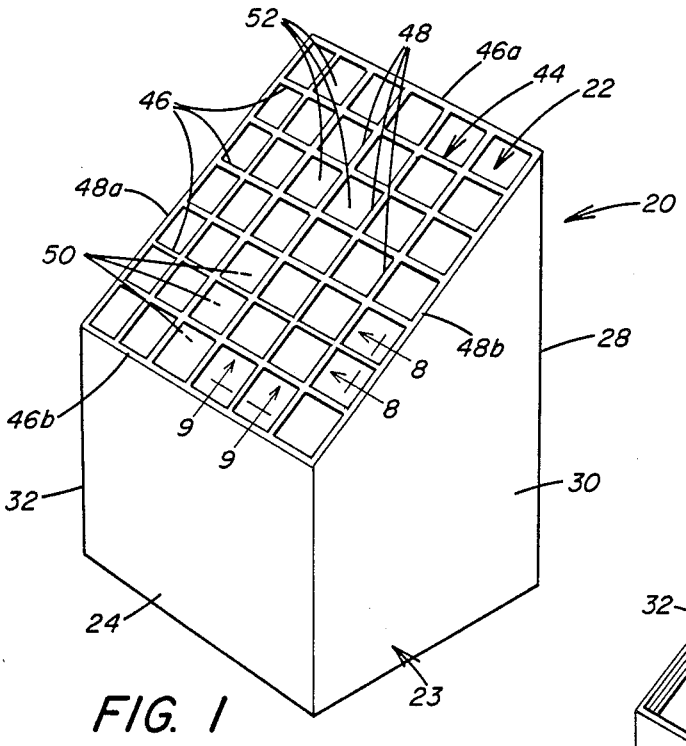
FIG. 1 is a diagrammatic, perspective view of a building having a sloped glazing system incorporating features of the present invention installed therein.

Referring now to FIG. 1, there is diagrammatically shown a building 20 having a skylight or sloped glazing system 22 embodying features of the present invention installed therein. Although the sloped glazing system 22 is depicted in FIG. 1 as being of the single-slope type, this configuration is not limiting to the present invention. For example, the sloped glazing system 22 may be of the gable type; the multi-sloped type; or the barrel vault type, or any other configuration or style which is consistent with prevailing architectural and/or building industry standards. The building 20 can suitably be of any convenient style, motif, or design, and is herein depicted as being of a high rise, monolithic construction. The type and/or construction of the building does not form any part of the instant invention, and is not limiting to the invention. The vertical walls 24, 28, 30 and 32 of the building 20 can suitably be vertical curtain walls, e.g. of the type sold by PPG Industries, Inc. under its registered trademark EFG ®. However, the type and/or construction of the vertical walls 24 is not limiting to the present invention, e.g. the vertical walls may be load-bearing or foundational walls constructed of any suitable building material, e.g. wood, metal, concrete, masonry, or the like.

Figure 2:
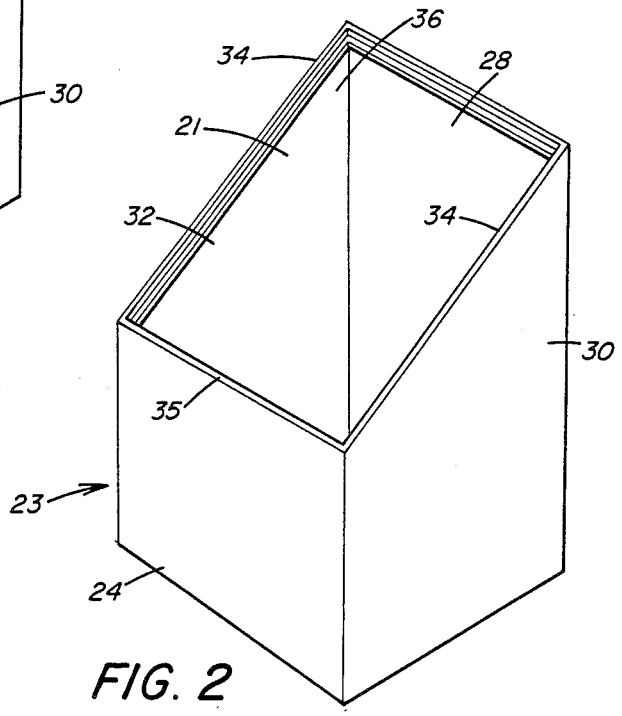
FIG. 2 is a perspective view of the building shown in FIG. 1, without the sloped glazing system installed therein.

The sloped glazing system 22 is adapted to be integrated with the building envelope or superstructure 23, in any convenient manner, to provide a sloped, overhead wall. For example, and not limiting to the invention, the building envelope or superstructure 23 comprises, as illustrated in FIG. 2, a first vertical wall 24, a second vertical wall 28 opposite to and longer/taller than the first vertical wall 24, and oppositely disposed third and fourth walls 30, 32, respectively, each having an angled or sloped upper edge 34. The first, second, third, and fourth vertical walls 24, 28, 30 and 32 are joined or interconnected together to enclose the building interior 21, and to define a roof opening 36 at the top of the building 20. If the vertical walls are foundational (e.g. made of masonry or concrete), a masonry or concrete curb 35 may be provided around the interior perimeter of the walls to define the roof opening 36 and to provide a surface for facilitating attachment of the sloped glazing system 22 to the building superstructure 23, in a manner as will hereinafter be more fully developed. If the vertical walls are curtainwalls, then the sloped glazing system 22 may be integrated with the vertical curtainwalls in a somewhat different manner, as will also be hereinafter fully developed. In any instance, the sloped glazing system 22 may be employed to cover the roof opening 36 or any portion(s) thereof, to thereby provide the roof or a portion of the roof of the building 20.

Referring again to FIG. 1, the sloped glazing system 22 includes a structural framing grid 44 comprised of a plurality of horizontal framing members or purlins 46 and vertical framing members or rafters 48 interconnected together to form a plurality of glazing openings 50. The rafters and purlins may be made of formed or rolled steel, stainless steel, or aluminum, extruded aluminum, or any other convenient material. The framing grid 44 has a pitch or slope of any suitable grade, e.g. from about 15° to about 75° as measured with respect to the horizontal plane of the building 20. Architectural panels 52 are mounted in covering relation to the glazing openings 50 to enclose the building 20. The architectural panels 52 may be made of any building material, e.g., glass, plastic, metal, cementitious slabs, or any other material suitable for sloped glazing installations. The panels 52 are preferably made of glass. The glazing panels 52 may be single or multiple-glazed and may have any desired features, e.g. optical, strength, safety, solar energy control, or other properties, and may be transparent, opaque, colored, or tinted. The type of panels 52 employed in the practice of the invention is not limiting to the present invention. However, in the context of sloped or overhead glazing systems, safety considerations and/or building codes may impose certain limitations on the type of glazing panels which may be employed.

Figure 3:
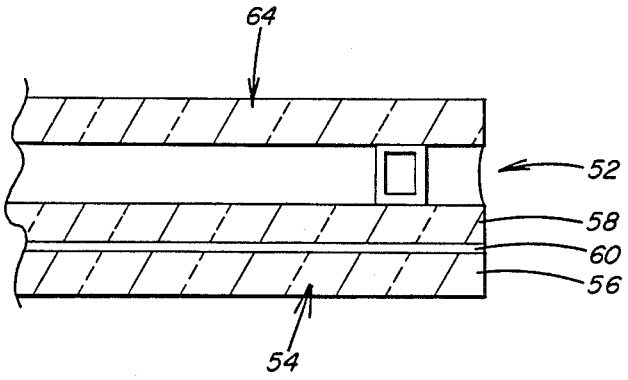
FIG. 3 is a fragmentary, transverse cross-sectional view of a laminated safety panel which may be used in the practice of the invention.

Referring also now to FIG. 3, a typical glazing panel 52 which is employed in sloped or overhead/skylight glazing systems comprises a multiple-glazed unit having an inside panel 54 and an outside panel 64, the inside panel 54 being comprised of a pair of glass sheets 56, 58 having an intermediate layer or interlayer 60 made of plastic, vinyl, polyurethane, or any other suitable material, sandwiched therebetween in any convenient manner as is well known in the pertinent art, to thereby provide a laminated safety panel. The glass sheets 56, 58 can be colored, tinted, coated, clear, heat or chemical strengthened, tempered, or have other strength, optical, and/or solar control properties appropriate to the sloped glazing system installation milieu. The outside panel 64 can comprise a single sheet of glass or two or more sheets of glass laminated together with interlayers of plastic or vinyl material or the like. The outside panel 64 can be strengthened, tinted, coated, colored, or have other strength, optical and/or solar control properties appropriate to the environment in which the sloped glazing system 22 is employed.

Figure 4:
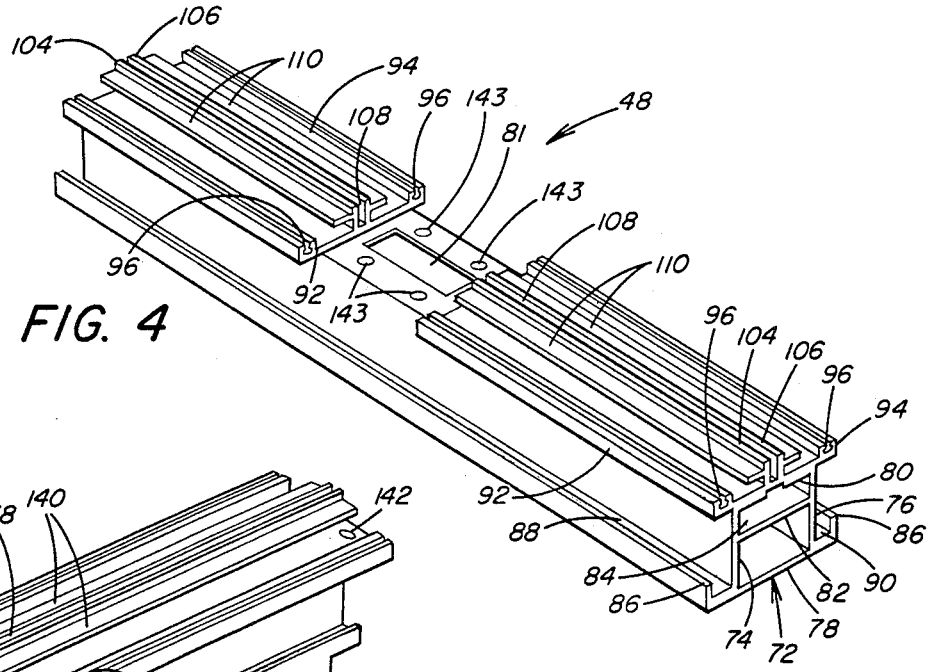
FIG. 4 is a perspective view of a preferred embodiment of a rafter employed in the sloped glazing system of this invention.

Referring now to FIG. 4, there is shown a typical one of the rafters 48. The rafter 48 is therein shown to have a longitudinally extending, primary structural portion 72 of generally tubular transverse cross-section. The structural portion 72 includes spaced, upstanding side walls 74, 76 integrally joined together by an inner end wall 78 and an outer end wall 80. The structural portion 72 preferably further includes a longitudinally extending, intermediate wall 82 integrally interconnecting the side walls 74, 76 in interposed relation to the inner end wall 78 and the outer end wall 80. The intermediate wall 82, the outer end wall 80, and the adjacent portions of the side walls 74, 76 define a longitudinally extending, internal drainage chamber 84, the functionality of which will be hereinafter developed. The inner end wall 78 extends laterally outwardly of the side walls 74, 76 and has an upstanding lip portion 86 extending longitudinally along each distal end thereof, to thereby provide condensation gutters 88, 90 flanking the primary structural portion 72, the functionality of which will also be hereinafter developed. The rafter 48 further includes longitudinally extending gasket lock flange portions 92, 94 projecting laterally outwardly from the opposite side edges of the outer end wall 80. The gasket lock flange portions 92, 94 are each provided with a keyway-like slot 96 adapted to interlockingly engage a key-like projection 98 provided on each of resilient, longitudinally extending glazing or sealing gaskets 100, 102, to thereby secure the sealing gaskets 100, 102 to the gasket lock flange portions 92, 94, respectively (see FIG. 9). The outer end wall 80 preferably further includes a pair of slightly spaced-apart, longitudinally extending, upstanding flanges 104, 106 defining a longitudinally extending fastener-receiving channel 108, the functionality of which will hereinafter be brought out. The upstanding flanges 104, 106 each preferably include a longitudinally extending flange 110 projecting laterally outwardly therefrom, to enhance the structural integrity thereof.

Figure 5:
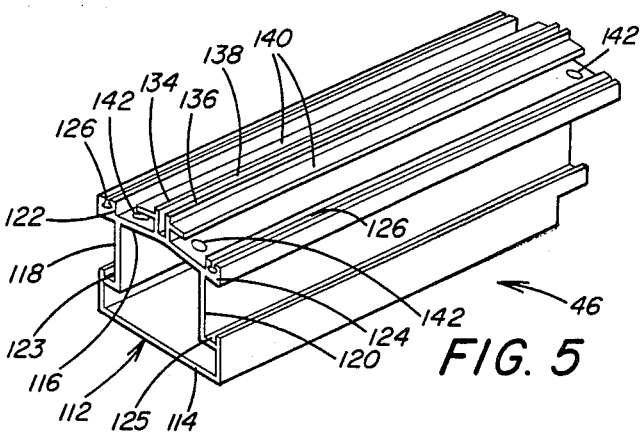
FIG. 5 is a perspective view of a preferred embodiment of a purlin employed in the sloped glazing system of this invention.

Referring now to FIG. 5, there is shown a typical one of the purlins 46. The purlin 46 is therein shown to include a horizontally extending, primary structural portion 112 of generally tubular transverse cross-section. The primary structural portion 112 includes an inner end wall 114 and an outer end wall 116 integrally interconnected by spaced, upstanding sides walls 118, 120. The purlin 46 further includes integrally formed condensation gutters 123, 125 extending along an intermediate portion of the side walls 118, 120, respectively. The purlin 46 also includes horizontally extending gasket lock flange portions 112, 124 projecting laterally outwardly from the opposite side edges of the outer end wall 116. The gasket lock flange portions 122, 124 are each provided with a keyway-like slot 126 adapted to interlockingly engage a key-like projection 128 provided on each of resilient, horizontally extending glazing or sealing gaskets 130, 132, to thereby secure the sealing gaskets 130, 132 to the gasket lock flange portions 122, 124, respectively (see FIG. 8). The outer end wall 116 preferably further includes a pair of slightly spaced-apart, horizontally extending, upstanding flange 134, 136 defining a horizontally extending fastener-receiving channel 138, the functionality of which will hereinafter be brought out. The upstanding flanges 134, 136 each preferably include a horizontally extending flange 140 projecting laterally outwardly therefrom, to enhance the structural integrity thereof.

Figure 6:
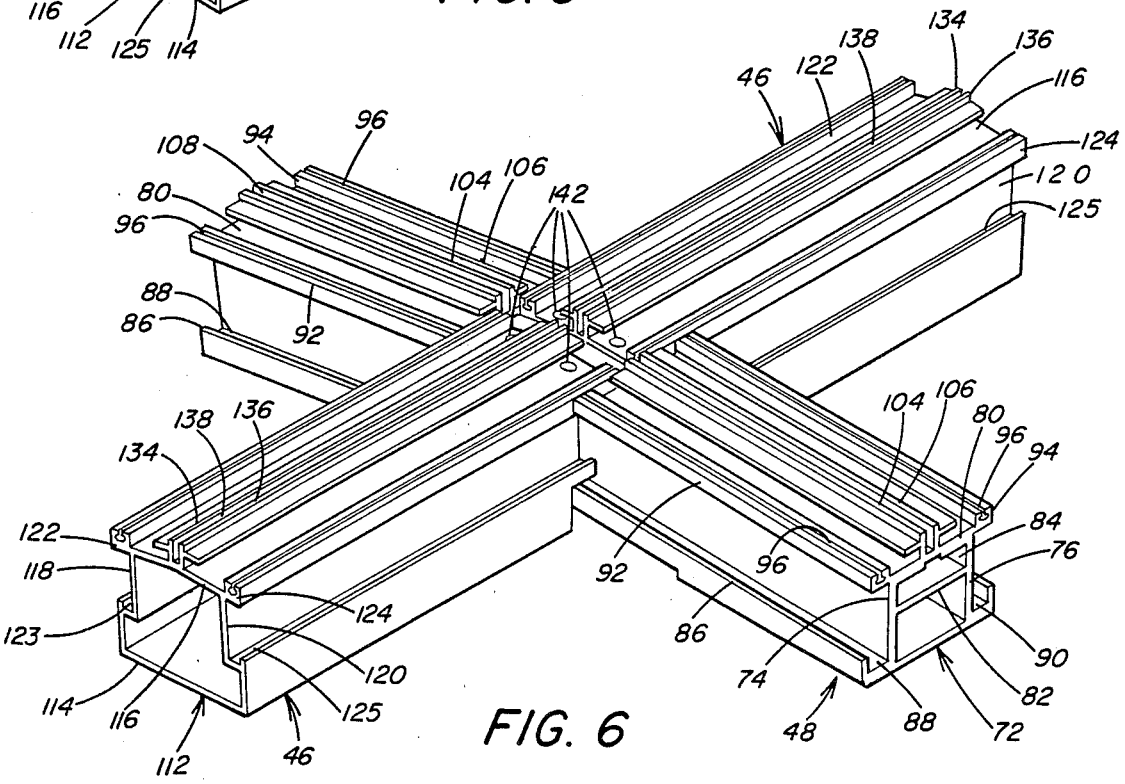
FIG. 6 is a perspective view of a typical rafter-purlin crossing of the sloped glazing system of this invention.

Referring additionally to FIG. 6, there is shown a typical intersection or rafter-purlin crossing of the structural framing grid 44 of the single-slope type sloped glazing system 22 depicted in FIG. 1. The gasket lock flange portions 92, 94 and the upstanding flanges 104, 106 of the rafter 48 are interrupted, e.g. milled out, cut out, notched out, or the like, at the rafter-purlin crossing, to accomodate the crossing purlin(s) 46. More particularly, the spacing between the longitudinally adjacent, milled out ends of the rafter gasket lock flange portions 92, 94 is preferably such that the milled out ends of the rafter gasket lock flange portions 92, 94 abut or virtually abut against the gasket lock flange portions 122, 124 of the crossing, horizontally adjacent purlins 46. The outer end wall 80 of the primary structural portion 72 of the rafter 48 is also interrupted, e.g. milled out, cut out, notched out, or the like, at the rafter-purlin crossing, to thereby provide an opening 81 through the outer end wall 80 in fluid communication with the internal drainage chamber 84 of the rafter 48, at the rafter-purlin crossing. However, the spaced, longitudinally adjacent portions of the milled out outer end wall 80 of the primary structural portion 72 extend beneath the outer end wall 116 of the primary structural portion 112 of the horizontally adjacent purlins 46, preferably on opposite sides of the fastener-receiving channel 138 of the purlins 46, to thereby facilitate interconnection of the rafter 48 to the purlins 46 in the following described preferred manner. More particularly, each of the horizontally adjacent purlins 46 is preferably provided with a hole or screw port 142 through the outer end wall 116 of its primary structural portion 112, on opposite sides of its fastener-receiving channel 138. Further, the longitudinally adjacent portions of the milled out outer end wall 80 of the structural portion 112 of the rafter 48 are each provided with a hole 143 disposed in vertical alignment with a screw pot 142 of one of the purlins 46, and another hole 143 disposed in vertical alignment with a screw port 142 of the other purlin 46. Each vertically aligned pair of screw ports 142 and holes 143 are conveniently threaded to threadingly engage bolts (not shwn), screws (not shown), or any other convenient type of fastener, to thereby securely interconnect the rafter 48 to the purlins 46. However, it should be appreciated that any other convenient technique, e.g. self-tapping fasteners or the like, can be employed to interconnect the rafter 48 to the purlins 46, as the type of interconnection facilities employed is not limiting to the present invention. For example, other suitable types of interconnection facilities are taught in U.S. Pat. Nos. 3,522,684; 4,050,201; 4,070,806; 4,114,330; 4,448,001; and 4,055,923, all teachings of which are herein incorporated by reference.

With continuing reference to FIG. 6, the condensation gutters 122, 124 of each purlin 46 are preferably interrupted at the rafter-purlin crossing to accomodate the intersectionally passing rafter 48. The condensation gutters 123, 125 of one of the purlins 46 preferably extend over the lip of the intersectionally passing rafter condensation gutter 88, but terminate short of the adjacent side wall 74 of the primary structural portion 72 of the rafter 48, to thereby fluidly interconnect the purlin condensation gutters 123, 125 with the rafter condensation gutter 88. The condensation gutters 123, 125 of the other purlin 46 preferably extend over the lip of the intersectionally passing rafter condensation gutter 90, but terminate short of the adjacent side wall 76 of the primary structural portion 72 of the rafter 48, to thereby fluidly interconnect the purlin condensation gutters 123, 125 with the rafter condensation gutter 90. Further, the upper portion of the side walls 118, 120 of both of the purlins 46 is interrupted to accomodate the crossing of the primary structural portion 72 of the rafter 48 between the horizontally adjacent purlins 46. Yet further, the lower portion of the side walls 118, 120 of both of the purlins 46 is interrupted to accomodate the crossing of the lip of the adjacent rafter condensation gutters 88, 90. The outer end wall 116 and the fastener-receiving channel 138 and the gasket lock flange portions 122, 124 carried thereby, is the only portion of the purlins 46 which crosses between the horizontally adjacent portions of the milled out outer end wall 80 of the primary structural portion 72 of the rafter 48. The spacing between the outer end walls 116 of the horizontally adjacent purlins 46 is preferably less than the width of the opening 81 communicating with the internal drainage chamber 84 of the rafter 84.

Although the typical rafter-purlin crossing was described above with horizontally adjacent or discrete purlins 46, it should be appreciated that, alternatively, a single, continuous purlin (not shown) may be employed to span the rafter-purlin crossing. The continuous purlin would be of the same transverse cross-section as the discrete purlins 46 and milled out or otherwise interrupted in the same manner as the purlins 46, as discussed hereinabove, except that the outer end wall 116 of the primary structural portion 112 of the continuous purlin would be additionally provided with drainage ports (not shown) disposed in fluid communication with the internal drainage chamber 84 of the adjacent rafter 48.

With primary reference now to FIGS. 1 and 2, the structural framing grid 44 is attached to the building 20 in any convenient manner which ensures the structural integrity of the sloped glazing system 22 and the weather tight integrity of the interior of the bulding 20. For example, the endmost rafters or jambs **48*a* and 48*b* are disposed immediately adjacent to the third and fourth vertical walls 30, 32, respectively, of the building 20, and the uppermost purlin or header 46*a* is disposed immediately adjacent to the second vertical wall 28 of the building 20. The opposite ends of the rafters 48 are preferably structurally attached to the vertical walls 24, 28 of the building 20. Facilities (not shown) are preferably provided to ensure a weathertight seal between adjacent portions of the sloped glazing system 22 and the vertical walls 24, 28, 30 and 32 of the building 20. Further, the bottommost purlin or sill 46*b* is adapted to seal off the bottom end of the rafters 48 and to receive, collect, and dispose of any moisture accumulated within the internal drainage chambers 84 of the rafters 48 and the condensation gutters 88, 90 of the rafters 48. The means for and manner of attaching the jambs 48*a*, 48*b*, the header 46*a*, and the sill 46*b* to the building 20 is not limiting to the invention. The various arrangements taught in U.S. Pat. No. 4,070,806 and 4,114,330, which teachings are herein incorporated by reference, are typical, convenient ways to attach the structural framing grid 44 to the building 20. A preferred structural framing grid securement arrangement is taught in U.S. application Ser. No. 768,985, entitled "Rafter With Internal Drainage Feature and Sloped Glazing System Incorporating Same", filed on Aug. 26, 1985 in the name of James A. Rockar and assigned to the assignee of the present invention, which teachings are herein incorporated by reference. Further, it should be appreciated that the structural framing grid 44 may be further supported at any number of points disposed interiorly of the vertical walls 24, 28, 30, and 32 of the building 20. For example, the structural framing grid 44 may be conveniently attached to a sub-framing system (not shown) at each or any selected ones of the rafter-purlin crossings. The sub-framing system may conveniently be comprised of a plurality of structural members, e.g. beams, girders, pipes, or the like, interconnected together to form a grid which is structurally attached to the building 20**.

Figure 7:
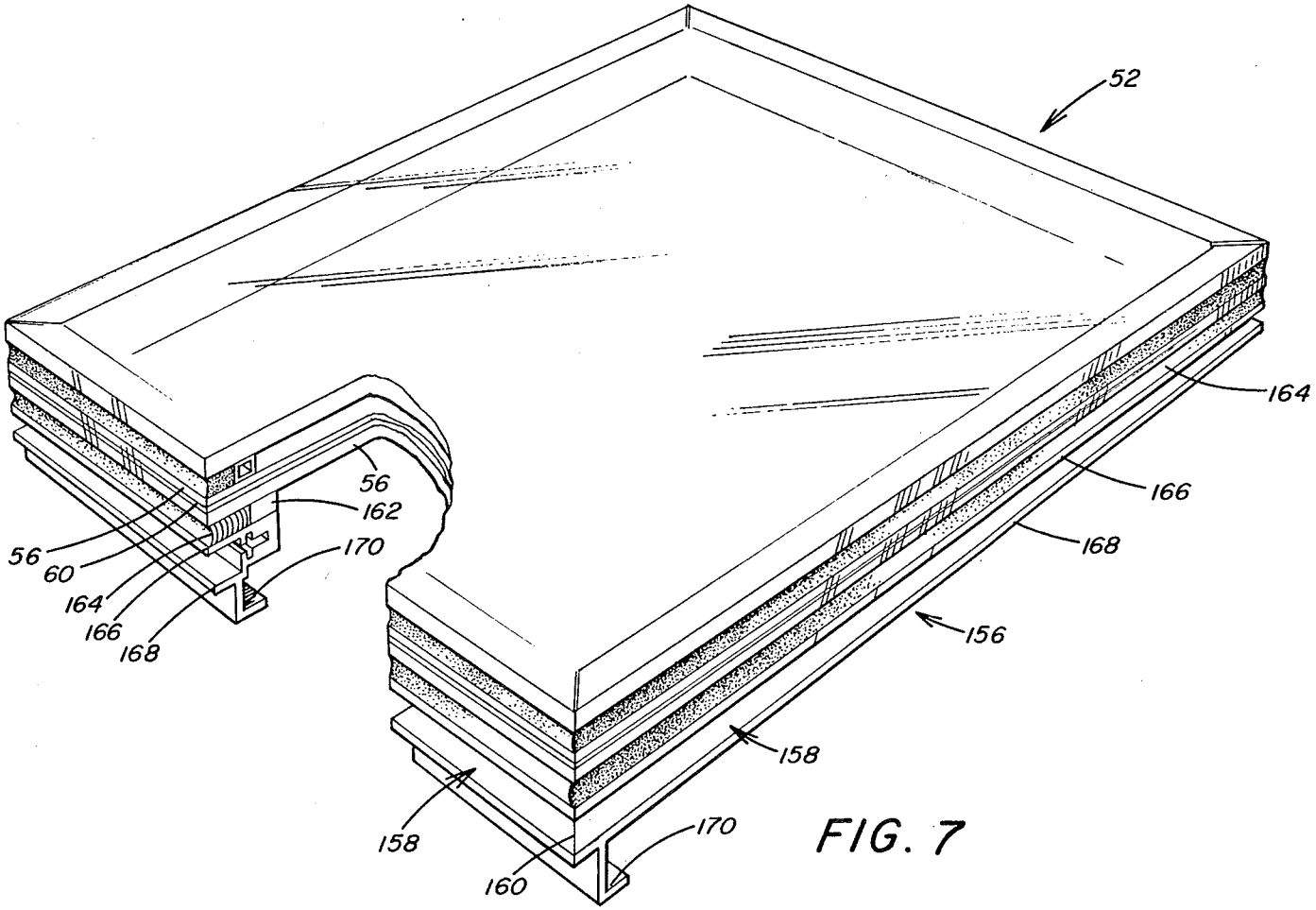
FIG. 7 is a perspective, partially cutaway view of a glazing panel with a hanger frame mounted thereto, preferably employed in the sloped glazing system of this invention.

The following discussion is directed to the securement of the glazing panels 52 to the structural framing grid 44 to cover the roof opening 36 of the building 20. In this vein, referring now to FIG. 7, a hanger frame 156 is secured to the inner surface of the inner glass sheet 58 of the inside panel 54 of each glazing panel 52. The hanger frame 156 is preferably comprised of four hanger sections 158 arranged in parallel relation to the four peripheral edges of the associated glazing panel 52. The ends of the hanger sections 158 are preferably mitered and the joints between adjacent mitered ends of the hanger sections 158 are preferably filled with a bead 160 of a moisture and dust resistant adhesive, e.g. of the type taught in U.S. Pat. No. 3,791,910, which teachings are herein incorporated by reference, to thereby provide a closed hanger frame 156 which is moisture and dust resistant. The hanger sections 158 of the frame 156 are conveniently secured to the inner surface of the inner glass sheet 56 by tape 162 having adhesive on its opposite surfaces (i.e. a two-sided tape) and a ribbon 164 of silicone adhesive, e.g. in a manner taught in U.S. Pat. No. 4,307,551, which teachings are herein incorporated by reference. However, it should be clearly understood that neither the specific configuration of the hanger sections 158 nor the manner of affixing them to the glass sheet 58 is limiting to this invention. Each of the hanger sections 158 is preferably generally C or channel-shaped, and the hanger sections 158 of adjacent glazing panels 52 preferably open towards each other. The distal edges of the outer and inner legs 166, 168, respectively, of each hanger section 158 are preferably flush with the adjacent peripheral edge of the associated glazing panel 52, although this is not limiting to the instant invention. Further, one (or more) of the hanger sections 158 is preferably provided with an integral, generally L-shaped hook portion 170 extending rearwardly and downwardly from its inner leg 168, for purposes which will be hereinafter fully brought out.

Figure 8:
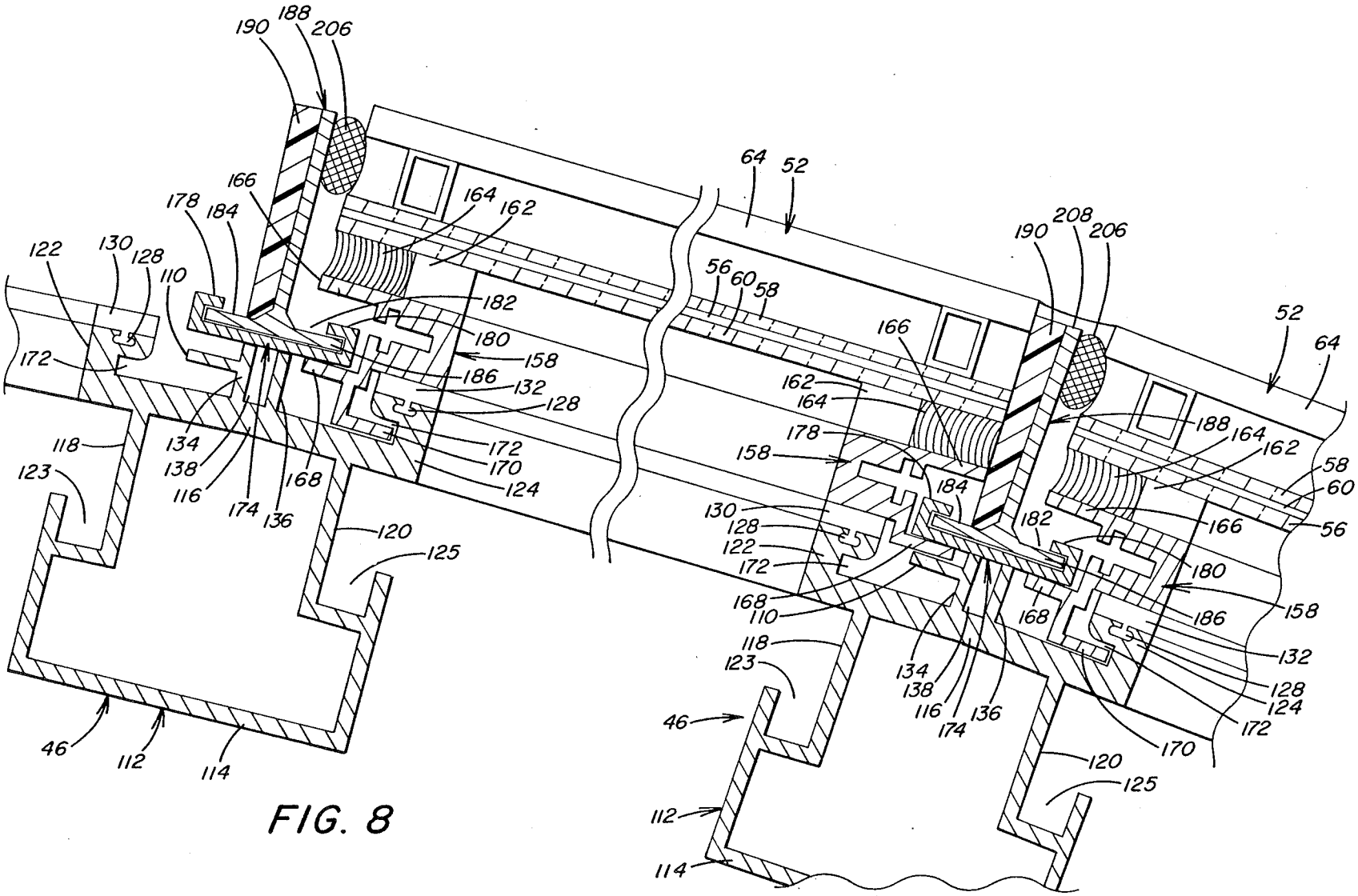
FIG. 8 is a transverse, cross-sectional view taken along the line 8—8 in FIG. 1.

With additional reference to FIG. 8, vertically adjacent ones of the glazing panels 52 with the hanger frame 156 preferably already affixed thereto, are preferably secured to the structural framing grid 44 in the following described manner. In general, a panel 52 to be installed is oriented with the hanger section 158 having the hook portion 170 aligned with the higher of two vertically adjacent purlins 46. The inner surface of the inner leg 168 of the hanger section 158 having the hook portion 170 is then brought into flushly abutting engagement with the exposed surface of the lower sealing gasket 132 carried by the lower gasket lock flange portion 124 of the associated purlin 46. The hook portion 170 is interlockingly engaged with a detent 172 formed by the gasket lock flange portion 124 and the outer end wall 116 of the higher one of the aforesaid purlins 46, thereby allowing the glazing panel 52 to be temporarily hung from the purlin 46 during the erection process, to facilitate easier and readier precise positioning of the panel 52 with respect to the structural framing grid 44. A lower, vertically adjacent panel 52 preferably has been previously secured between the sill **46*b* and the lower one of the aforesaid vertically adjacent purlins 46, with the hook portion 170 of the hanger frame 156 of the lower one of the panels 52 preferably interlockingly engaging the detent 172 formed by the gasket lock flange portion 124 and the outer end wall 116 of the lower one of the aforesaid vertically adjacent purlins 46. A generally plate-like retainer strip or pressure bar 174 is then inserted between the vertically adjacent panels 52, with a central portion of the pressure bar 174 being supported by the upper edges of the upstanding flanges 134, 136 defining the fastener-receiving channel 138 of the lower one of the purlins 46. The pressure bar 174 bridges or spans the space between the adjacent hanger sections 158 of the vertically adjacent panels 52, with the opposite marginal edge portions of the pressure bar 174 being supported by the inner leg 168 of the adjacent hanger sections 158 associated with the vertically adjacent panels 52. The pressure bar 174 preferably extends continuously along the horizontal dimension of the structural framing grid 44 between horizontally adjacent rafter-purlin crossings. A plurality of fasteners (not shown), e.g. self-tapping bolts, screws, or the like, are preferably employed at appropriate intervals to secure the pressure bar 174 to the associated purlin 46, with the shank portion (not shown) of the fasteners 176 bottoming out or seating within the fastener-receiving channel 138 of the purlin 46. The tightening force applied to the fasteners compressively biases or urges the sealing gaskets 130, 132 associated with the purlin 46 to bear outwardly and seal against the bottom surfaces of the adjacent hanger sections 158 of the vertically adjacent panels 52. The tightening force applied to the pressure bar 174 also serves to secure the vertically adjacent panels 52 to the associated purlin 46. Further, the pressure bar 174 is preferably provided with inturned, generally L-shaped upstanding flanges 178, 180 extending continuously along the opposite side edges of the pressure bar 174, to thereby provide a channel 182 along the length of the pressure bar 174. The channel 182 functions to capture flanges 184, 186 extending laterally outwardly from a vertically oriented plate-like member or setting block chair 188 extending between the vertically adjacent panels 52. A plurality of setting block chairs 188, each having a length substantially less than the distance between horizontally adjacent rafter-purlin crossings, are preferably captured by the pressure bar 174. For example, 6 inch (15.24 cm.) long setting block chairs 188 may be provided at the quarter points between horizontally adjacent rafter-purlin crossings which are 6 feet 3 inches (190.5 cm.) apart, although this is not limiting to the invention. The setting block chairs 188 are preferably slide fit into the channel 182 prior to securement of the pressure bar 174 to the associated purlin 46, although this is also not limiting to the invention. Once the setting block chairs 188 carried by the pressure bar 174 are in place, a plurality of resilient edge or setting blocks 190 are inserted between the corresponding setting block chairs 188 and the lower, horizontal edge of the higher one of the glazing panels 52. The type of setting blocks 190 employed is not limiting to the invention. For example, the setting blocks 190 may be made of dense [e.g. 40±5 durometer (Shore A)] neoprene or any other conveniently suitable material. The setting blocks 190 serve to vertically support the adjacent glazing panel 52** on its lower, horizontal edge.

Figure 9:
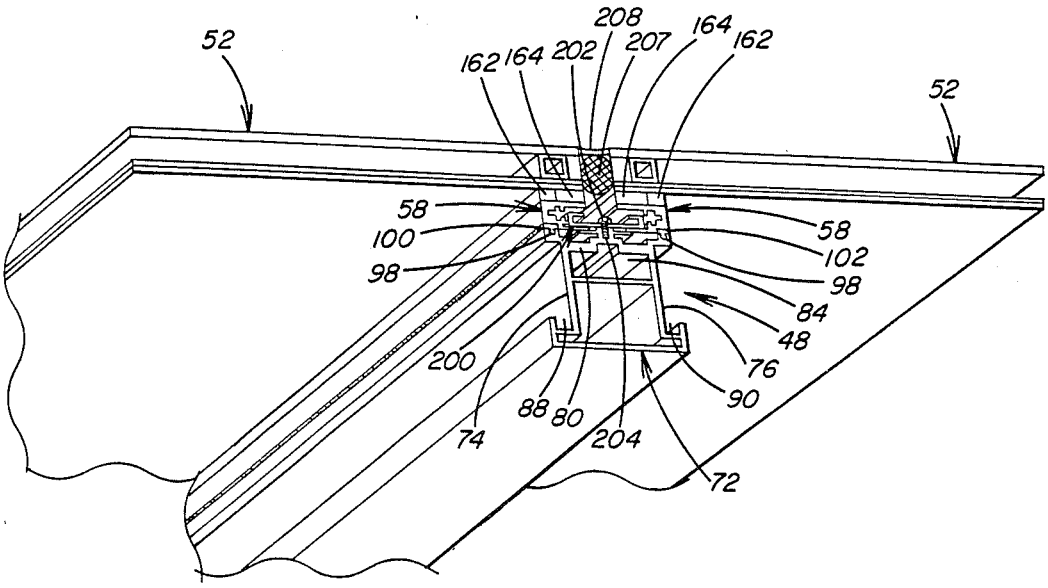
FIG. 9 is a perspective, cross-sectional view taken along the line 9—9 in FIG. 1.

With additional reference now to FIG. 9, horizontally adjacent ones of the glazing panels 52 with the hanger frame 156 preferably already affixed thereto, are preferably secured to the structural framing grid 44 in the following described manner. In general, a panel 52 is installed horizontally adjacent to one of the hereinbefore described vertically adjacent pair of panels 52. A generally plate-like retainer strip or pressure bar 200 is inserted between the horizontally adjacent panels 52, with a central portion of the pressure bar 200 being supported by the upper edges of the upstanding flanges 104, 106 defining the fastener-receiving channel 108 of the associated rafter 48. The pressure bar 200 bridges or spans the space between the adjacent hanger sections 158 of the horizontally adjacent panels 52, with the opposite marginal edge portions of the pressure bar 200 being supported by the inner leg 168 of the adjacent hanger sections 158 associated with the horizontally adjacent panels 52. The pressure bar 200 preferably extends continuously along the vertical dimension of the structural framing grid 44 between vertically adjacent rafter-purlin crossings. A plurality of fasteners 202, e.g. self-tapping bolts, screws, or the like, are preferably employed at appropriate intervals to secure the pressure bar 200 to the associated rafter 48, with the shank portion 204 of the fasteners 202 bottoming out or seating within the fastener-receiving channel 108 of the rafter 48. The tightening force applied to the fasteners 202 compressively biases or urges the sealing gaskets 100, 102 associated with the rafter 48 to bear outwardly and seal against the bottom surfaces of the adjacent hanger sections 158 of the horizontally adjacent panels 52. The tightening force applied to the pressure bar 200 further serves to secure the horizontally adjacent panels 52 to the associated rafter 48.

It should be fully appreciated that the order or sequence in which the glazing panels 52 are mounted to the structural framing grid 44 is not limiting to the invention. For example, the panels 52 may be mounted from left to right, top to bottom, center to outside, or in any other convenient manner.

The exterior spacing between all adjacent panels 52 is preferably sealed in the following described manner. Referring now to FIG. 8, in the case of vertically adjacent panels 52, a backer rod 206 is inserted between the upper, horizontal edge of a panel 52 and each setting block chair 188 associated with the purlin 46 to which the panel 52 is mounted. Although not shown in FIG. 8, a backer rod 206 is also inserted, between the occurrence of setting block chairs 188, to span the space between the lower, horizontal edge and the upper, horizontal edge of the vertically adjacent panels 52. Referring now to FIG. 9, in the case of horizontally adjacent panels 52, a backer rod 207 is inserted between the adjacent vertical edges of the horizontally adjacent panels 52. Thereafter, a bead 208 of an adhesive sealant material is inserted into the space between adjacent panels 52 to seal the space from environmental elements, e.g. moisture, dirt, dust or the like. In the case of the vertically adjacent panels 52, an adhesive sealant bead 208 is inserted in covering relation to the setting blocks 190, the upper edge of the setting block chairs 188, and the backer rods 206. In the case of the horizontally adjacent panels 52, the adhesive sealant bead 208 is inserted in covering relation to the backer rod 207. The backer rods 206, 207 may be constructed of any convenient material, e.g. a closed-cell polyurethane material, and the adhesive sealant beads 208 may conveniently comprise a silicone adhesive or the like. For a more detailed discussion of an external flush-glazed curtain-wall wherein the spaces between adjacent panels are sealed off in the above-described manner, reference may be had to U.S. Pat. No. 4,543,755, assigned to the assignee of the present invention, which teachings are herein incorporated by reference.

The moisture control mechanism of the sloped glazing system 22 of the present invention works in a very similar manner to that taught in the previously incorporated U.S. application Ser. No. 768,985 filed Aug. 26, 1985 in the name of James A. Rockar. More particularly, any moisture which leaks or intrudes past the sealant beads 208 towards the interior of the sloped glazing system 22, flows along the outer end wall 80 of the primary structural portion of the rafter(s) 48 and/or the outer end wall 116 of the primary structural portion 112 of the purlin(s) 46, due to gravity flow engendered by virtue of the sloped contour of the system. All of the intruded moisture is discharged at the rafter-purlin crossings into the internal drainage chambers 84 of the rafters 48. In this manner, all of the intruded moisture present throughout the sloped glazing system 22 is zonally collected in the rafter drainage chambers 84. All of the thusly collected intruded moisture is then discharged from the bottom end of the rafter drainage chambers 84 into the sill **46*b* and thence, from the sill 46*b*** to any convenient moisture disposal facility, such as described in the above-referenced Rockar patent application.

Further, all of the moisture which forms by condensation on the inner surfaces of the panels 52, the rafters 48, and the purlins 46 is collected in the rafter condensation gutters 88, 90, and the purlin condensation gutters 123, 125. Yet further, all of the condensation moisture collected in the purlin condensation gutters 123, 125 is discharged into the rafter condensation gutters 88, 90 at the rafter-purlin crossings. In this manner, all of the condensation moisture present throughout the sloped glazing system 22 is zonally collected in the rafter condensation gutters 88, 90. All of the thusly collected condensation moisture is then discharged from the bottom end of the rafter condensation gutters 88, 90 in a gutter (not shown) provided by the sill **46*b***, and thence, from the sill gutter to any convenient moisture disposal facility, such as described in the above-referenced Rockar patent application.

However, it should be clearly understood that the construction and/or configuration of the rafters 48 and purlins 46 is not limiting to the present invention. For example, the transverse cross-section may be I-shaped, H-shaped, or may be of any other convenient structural shape. Further, the above-described moisture control mechanism is not limiting to the invention and any other convenient type of moisture control system may suitably be employed in the practice of this invention. Further, the construction and/or configuration of the pressure bars 174, 200 is not limiting to the invention, as long as they serve to securably interconnect adjacent panels 52 to the adjacent purlin 46 or rafter 48, respectively.

Many other modifications and/or variations of the basic inventive concepts herein taught which may appear to those skilled in the pertinent art will also fall within the spirit and scope of the present invention, which should be interpreted solely on the basis of the following claims.

What is claimed is:

1. A sloped glazing system for a building or the like, comprising:

a plurality of purlins;

a plurality of rafters;

means for interconnecting said rafters and purlins to form a grid having a plurality of glazing openings;

means for mounting said grid to structure of the building;

a glazing panel mounted in selected ones of said plurality of glazing openings, each said panel having an inner major surface facing towards interior of the building and an opposite outer major surface;

hanger means mounted to inner surface of said each panel adjacent to each side edge thereof, said hanger means comprising a generally channel-shaped member with adjacent channel-shaped members of adjacent panels having an opening facing each other;

means engaging said hanger means for securing said panels within its respective glazing opening, said securing means comprising means for engaging hanger means at each side of said panel and adjacent hanger means of adjacent panels to secure said hanger means of said panel and said adjacent panels to each other and to said grid;

setting block supporting means extending between adjacent horizontal edges of said adjacent panels as mounted, said setting block supporting means being slidingly interengaged with said securing means;

setting block means interposed between said setting block supporting means and adjacent lower horizontal edge of said adjacent panel for vertically supporting said panel; and means for sealing spaces between adjacent peripheral edge portions of said adjacent panels.

2. The system as set forth in claim 1, wherein said securing means includes a center slot and a side groove on each side of said slot with the opening of said slots facing one another and said setting block supporting means comprises a plurality of spaced-apart, vertically oriented plate-like members each having oppositely directed flanges extending laterally outwardly therefrom, said flanges being captured in said side grooves of said securing means.

3. The system as set forth in claim 1 wherein said mounting means mounts said grid at an oblique angle with respect to horizontal plane of the building structure.

4. A sloped glazing system for a building or the like, comprising:

a plurality of purlins;

a plurality of rafters, wherein one of said purlins or said rafters includes a detent portion;

means for interconnecting said rafters and purlins to form a grid having a plurality of glazing openings;

means for mounting said grid to structure of the building;

a glazing panel as viewed from outside the building having a top edge, a bottom edge, a right side and a left side mounted in each of three adjacent glazing openings with said top edge of first panel spaced from said bottom edge of second panel, and said top edge of said second panel spaced from said bottom edge of third panel, each said panels having an inner major surface facing towards interior of the building and an opposite outer major surface;

hanger means mounted to inner surface of each of said panels, said hanger means including a member having a groove to provide peripheral grooves at said edges of said panels wherein one or more of said hanger means further comprises a hook portion and said hook portion engages said detent of said purlin or said rafter;

a plate engaging adjacent grooves at said top and bottom edges of said panels;

means for securing said plate to adjacent portion of said rafter;

setting block support means; and means for securing said setting block support means between said upper and lower edges of said adjacent panels.

5. The system as set forth in claim 4, wherein said securing means comprises an elongated, generally plate-like member having a first marginal edge portion engaged by a one of said hanger means of said panel, an opposite marginal edge portion engaged by said hanger means of one of said adjacent panels, and an intermediate portion.

6. The system as set forth in claim 4, wherein one or more of said purlins comprises a structural portion provided with means carrying one or more sealing gaskets, said carrying means and a surface portion of said structural portion defining an elongated groove, and wherein further, one or more of said hanger means disposed adjacent the upper horizontal edge of said panel to which it is mounted, comprises an elongated hook portion cooperatively engageable with said elongated groove of an adjacent one of said purlins.

7. The system as set forth in claim 4 wherein said mounting means mounts said grid at an oblique angle with respect to horizontal plane of the building structure.

8. A sloped glazing system for a building or the like, comprising:

a plurality of purlins;

a plurality of rafters;

means for interconnecting said rafters and purlins to form a grid having a plurality of glazing openings;

means for mounting said grid to structure of the building;

a glazing panel as viewed from outside the building having a top edge, a bottom edge, a right side and a left side mounted in each of three adjacent glazing openings with said top edge of first panel spaced from said bottom edge of second panel, and said top edge of said second panel spaced from said bottom edge of third panel, each said panels having an inner major surface facing towards interior of the building and an opposite outer major surface;

hanger means mounted to said inner surface of each of said panels, said hanger means including a member having a groove to provide peripheral grooves at said edges of said panels;

plate means engaging adjacent grooves at said top and bottom edges of said panels, wherein said plate means comprises a plurality of elongated members, each of said elongated members has an inverted T shape having ends of the cross member in said grooves and center leg upstanding between edges of adjacent panels and wherein further each said elongated member is attached to an adjacent one of said purlins or an adjacent one of said rafters;

means for securing said plate means to adjacent portion of said rafter;

setting block support means; and means for securing said setting block support means between said upper and lower edges of said adjacent panels.

9. The system as set forth in claim 8, wherein said rafter structural portion is further provided with an elongated, fully enclosed, internal moisture drainage chamber which is provided with moisture-receiving openings at the rafter-purlin crossings.

10. The system as set forth in claim 9, wherein said rafter and said purlin structural portions each further comprise a pair of elongated condensation gutters extending along opposite sides thereof, said purlin condensation gutters emptying into said rafter condensation gutters.

11. The system as set forth in claim 8 wherein said mounting means mounts said grid at an oblique angle with respect to horizontal plane of the building structure.

12. A sloped glazing system for a building or the like, comprising:

a plurality of purlins;

a plurality of rafters wherein one of said purlins or said rafters includes a detent portion;

means for interconnecting said rafters and purlins to form a grid having a plurality of glazing openings;

means for mounting said grid to structure of the building;

a glazing panel mounted in selected ones of said plurality of glazing opening, each said panel having an inner major surface facing towards interior of the building and an opposite outer major surface;

hanger means mounted to inner surface of said each panel adjacent to each side edge thereof, said hanger means comprising a generally channel-shaped member with adjacent channel-shaped members of adjacent panels having an opening facing each other wherein one or more of said hanger means further includes a hook portion and said hook portion engages said detents of said purlin and said rafter;

means engaging said hanger means for securing said panels within its respective glazing opening, said securing means comprising means for engaging hanger means at each side of said panel and adjacent hanger means of adjacent panels to secure said hanger means of said panel and said adjacent panels to each other and to said grid; and means for sealing spaces between adjacent peripheral edge portions of said adjacent panels.

13. The system as set forth in claim 12, wherein each of said rafters and each of said purlins are provided with means for retaining sealing gaskets.

14. The system as set forth in claim 13, further comprising:

first fastener means for securing said securing means to underlying portion of said rafter; and second fastener means for securing said securing means to underlying portion of said purlin.

15. The system as set forth in claim 14, wherein each said hanger means bears against a one of said sealing gaskets of an adjacent one of said purlins or an adjacent one of said rafters.

16. The system as set forth in claim 15, wherein:

said first fastener means exerts a force which compressively biases said one of said sealing gaskets to bear outwardly and seal against the adjacent hanger means; and said second fastener means exerts a force which compressively biases said one of said sealing gaskets to bear outwardly and seal against the adjacent hanger means.

17. The system as set forth in claim 16, wherein each of said rafters and each of said purlins comprises a structural portion provided with said carrying means and fastener-receiving means.

18. The system as set forth in claim 17, wherein said fastener-receiving means comprises a pair of spaced-apart, elongated flanges extending upwardly along the longitudinal dimension of said structural portion.

19. The system as set forth in claim 12 wherein said mounting means mounts said grid at an oblique angle with respect to horizontal plane of the building structure.

20. The system as set forth in claim 12, wherein said hanger means are each mounted to said panel inner major surface by means of a a silicone adhesive and a spacer means.

21. The system as set forth in claim 20, wherein said hanger means are configured to form a hanger frame mounted to said inner major surface of each of said panels.

* * * * *